US005097611A

United States Patent [19]

Smollar et al.

[11] Patent Number: 5,097,611

[45] Date of Patent: Mar. 24, 1992

[54] DISPLAY APPARATUS

[75] Inventors: Marvin Smollar, Northbrook; Richard B. Mazursky, Glenview; William F. Walter, Riverwoods, all of Ill.

[73] Assignee: Marchon, Inc., Vernon Hills, Ill.

[21] Appl. No.: 550,467

[22] Filed: Jul. 10, 1990

[51] Int. Cl.[5] ..... G09F 11/21

[52] U.S. Cl. ..... 40/514

[58] Field of Search ..... 40/514, 515, 517; 160/296

[56] References Cited

U.S. PATENT DOCUMENTS 4,188,992 2/1980 Segerljung ..... 160/296

4,292,751 10/1981 Snyder, Jr. ..... 40/517

*Primary Examiner*—Kenneth J. Dorner

*Assistant Examiner*—J. Bonifanti

*Attorney, Agent, or Firm*—Laff, Whitesel, Conte & Saret

[57] ABSTRACT

An advertising and information display includes a mounting bracket for attaching the display to a conventional retail shelving unit or other structural support, a fixed carrier for holding a relatively small, continuously displayed information medium, and a flexible, user-operable, automatically-retracting carrier for holding a substantially larger, intermittently displayed information medium. The fixed carrier holds a removable user-enticing placard that does not interfere visually or physically with nearby exhibits or products located on that or adjacent shelves. The flexible carrier is preferably a plastic, cloth, or paper sheet which is mounted behind the fixed carrier on a spring-loaded roller or other automatically retracting storage device. A brake preferably controls retraction speed.

9 Claims, 3 Drawing Sheets

Fig. 1
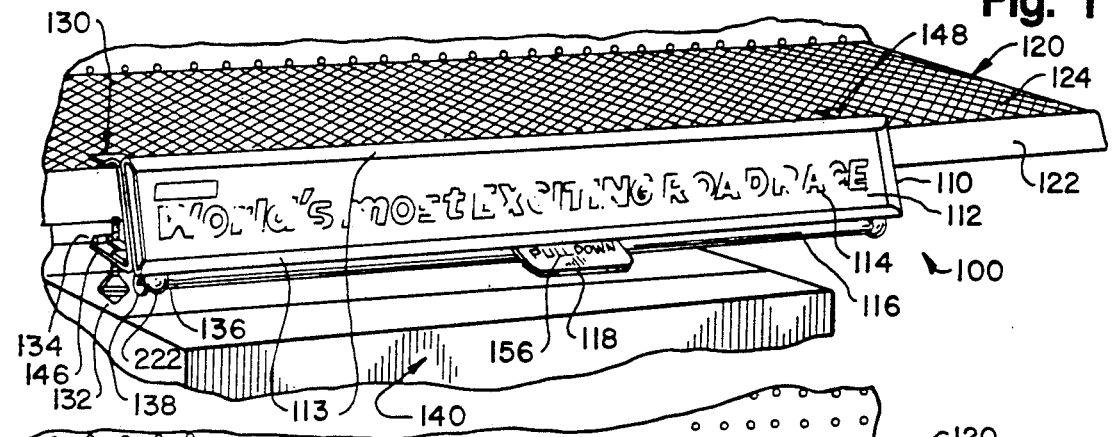
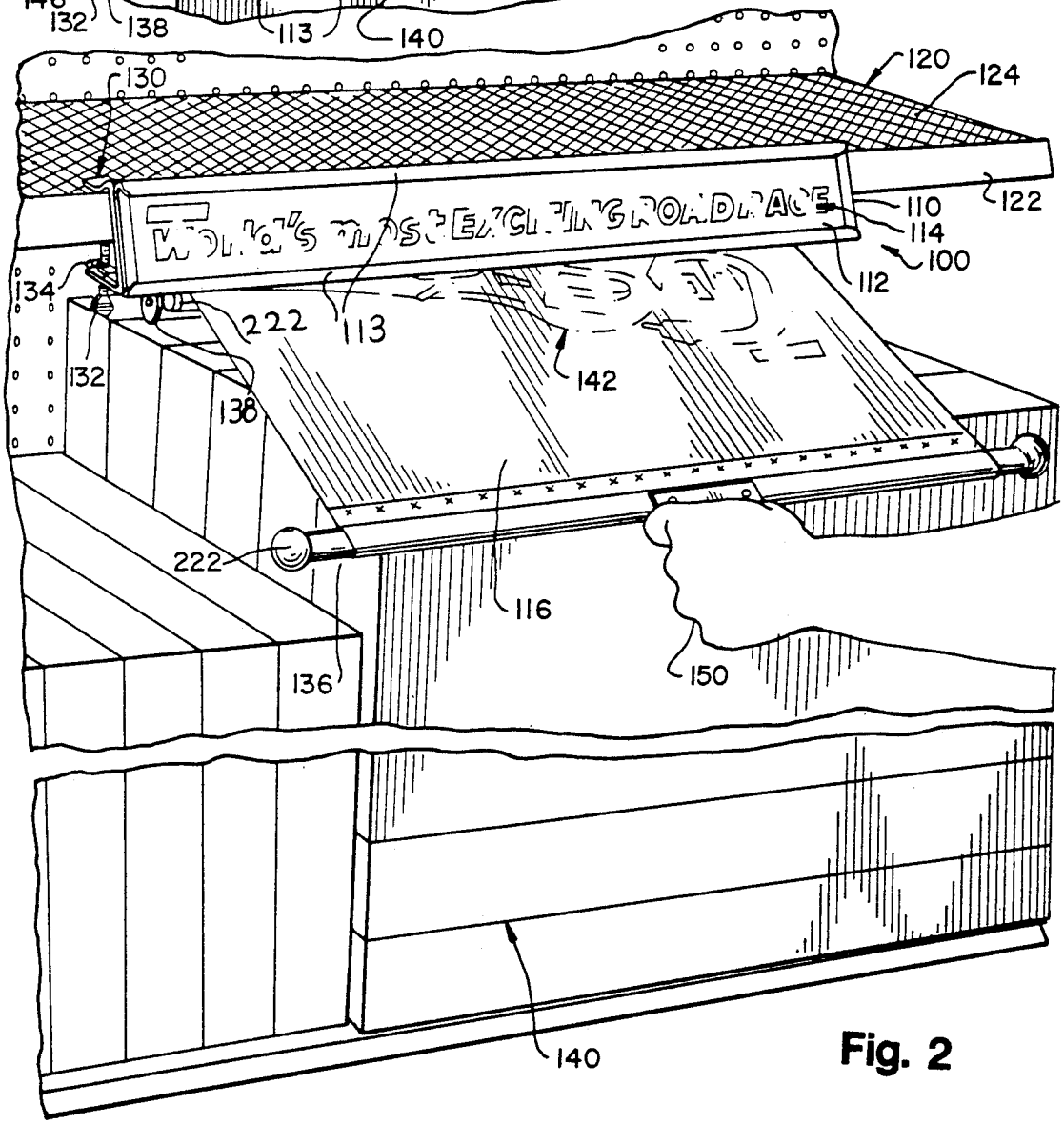
Fig. 2

146
110
100
148
112
114
WORLD'S MOST EXCITING ROAD RACE
PULL DOWN
144
138
132
222
156
118
136
154
152

112
146
114
110
100
148
WORLD'S MOST EXCITING ROAD RACE
132
138
144
138
132
"ADVERTISING MESSAGE"
116
142
222
136
194
PULL DOWN
118
222
156
150

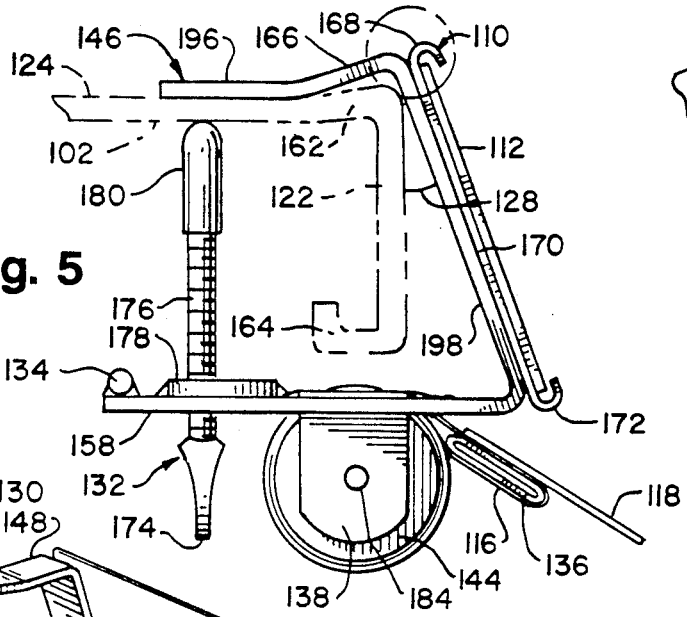
Fig. 5
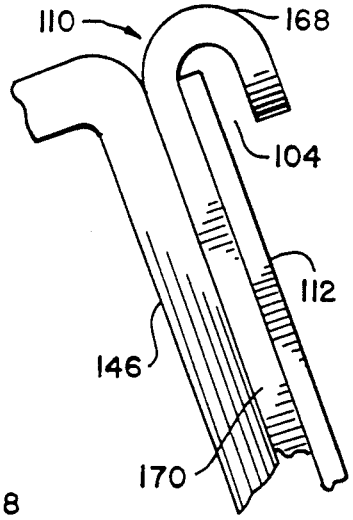
Fig. 6
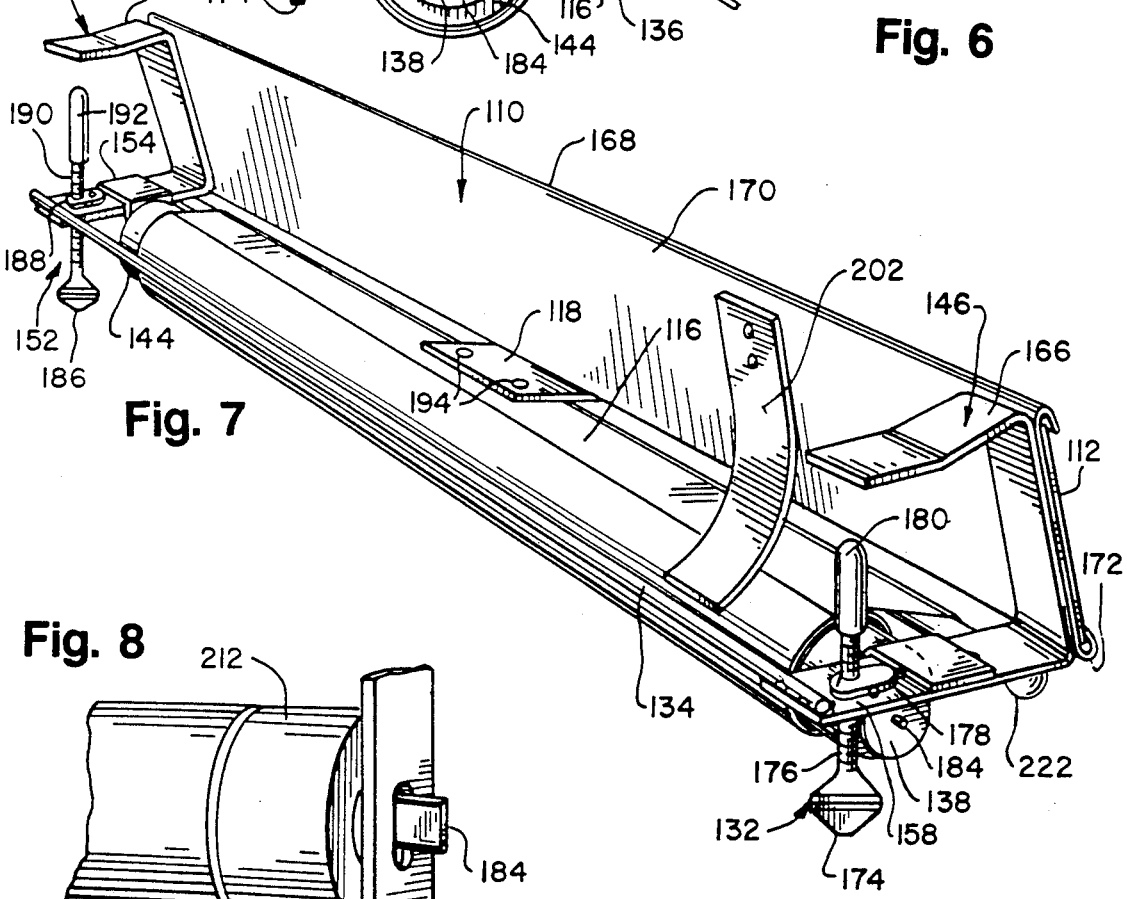
Fig. 7
Fig. 8
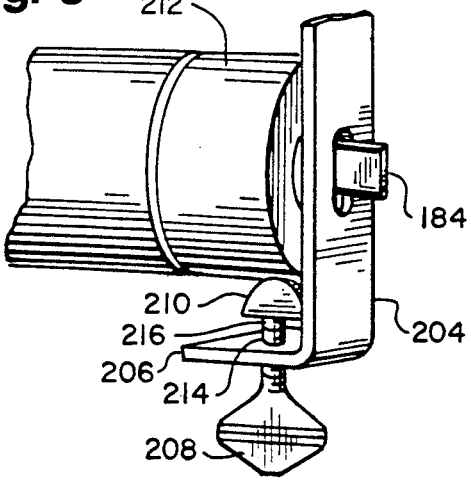

DISPLAY APPARATUS

BACKGROUND OF THE INVENTION

This invention relates to display apparatus, and more particularly to advertising and information displays adapted for installation on fixtures in retail stores and other places visited by the general public.

Typical self-service retail stores, such as drug stores, supermarkets, and toy stores, have long rows of multiple-tier shelving units which are used to house products. In contrast to traditional retail stores, in which products might be displayed in a showcase but stocked elsewhere, and in which a clerk would retrieve the product from the stocking location and dispense it to the purchaser, the consumer-accessible shelving fixtures of modern stores perform all three of these functions. The product, or at least its exterior packaging, is visibly displayed on the shelf. Generally, many units of a particular product are stocked at that shelf; in many stores, the entire inventory of the product is stocked exclusively in publicly-accessible shelving fixtures. Since the consumer may select product from the shelf without the assistance of a clerk, the shelving also performs the dispensing function.

It is highly desirable to display advertisements or promotions for products at their shelf locations. While products are generally visible on their shelf, the mere presence of the product may be insufficient to stimulate consumer interest. The product may be enclosed in a small package, so that there is no large "advertising" surface to catch the consumer's eye, or the available space on the package may be insufficient to contain all the information that the manufacturer or retailer wishes to impart to a potential purchaser. Alternatively, a product may be packaged in a plain wrapping, or as in the case of fresh produce, no wrapping. Also, it is often inappropriate to put a special promotion on a product's packaging since the promotion may only run for a limited time period.

Manufacturers and retailers are also becoming aware that advertising is not merely effective when it appears on television, in a magazine or newspaper or on a billboard. In fact, in-store, and in particular "point-of-purchase", advertising has proven itself highly effective in motivating a consumer's purchase. The invention may also be mounted on the walls or any other location where the benefits described can be utilized. Accordingly, manufacturers and retailers have a need to display at the point of sale advertisements and other informational material concerning products. But space for displaying advertisements is often a scarce resource in modern retail stores. Since a free-standing advertising display would use space that could otherwise be occupied by product shelving or interfere with the store's traffic, such displays are often economically inefficient or disfavored by retailers. One solution to this problem is to attach a stationary display, such as a poster or sign to the shelving in order to advertise an adjacent product. However, a large advertising poster would prevent viewing of the underlying products, and may interfere with the consumer's removal of such products from the shelf. Moreover, the visual clutter that such signs may create would not conform to the orderly appearance that most retailers seek to maintain on their counters. While the size of the poster could be substantially reduced, this approach suffers from the same disadvantage that affects small product packages: there is insufficient room to display all the desired information. Furthermore, the shelving may not readily accommodate any suitable signage presently available.

The problem of limited space for displaying information is not unique to the retail store environment. Many other places visited by the general public experience a similar problem with insufficient space to display information. Museums, zoos, and other institutions often desire to display additional descriptive information for an exhibit, but are constrained by available exhibit space. In other cases, such as art museums, aesthetic considerations make the display of extensive written or graphic information adjacent an exhibit objectionable.

SUMMARY OF THE INVENTION

Accordingly, it is an object of the present invention to provide an advertising and information display which may be mounted on a fixture or support such that a large message may be displayed without significantly obscuring products located on the shelf.

It is another object of the present invention to provide an advertising and information display which may be mounted on a retail-store fixture or support such that a large message may be displayed without interfering with removal of products located on the shelf.

An advertising and information display according to the present invention includes a mounting bracket for removably attaching the display to a conventional retail shelving unit or other structural fixture, a fixed carrier for holding a relatively small, continuously displayed information medium, and a flexible, user-operable, automatically-retracting carrier for holding a substantially larger, intermittently displayed information medium. The fixed carrier is essentially rectangular and holds a removable placard for enticing the viewer. The fixed carrier and placard may be of any convenient width less than or equal to that of the receiving shelving unit or support. However, the vertical dimension of the fixed carrier and placard is preferably limited to an appropriate size so that these components do not extend significantly above or below the shelf to which the display is mounted, thereby avoiding interfering visually or physically with products located on that or adjacent shelves. In non-retail applications, the limited vertical dimension similarly prevents interference with vertically adjacent exhibits.

The flexible carrier is preferably a plastic or cloth sheet which is mounted behind the fixed carrier on a spring-loaded roller or other automatically retracting storage means. The flexible carrier may be several feet long and has imprinted thereon an advertising or informational message. A prominent tab or handle attached to the flexible carrier extends outward and downward from the fixed carrier to permit a consumer to pull the flexible carrier into its display position. The pull tab displays a message inviting a consumer to "PULL DOWN FOR ADDITIONAL INFORMATION" or another suitable message to encourage the consumer or viewer to interact with the display.

In operation, the flexible carrier is initially stowed in its hidden, retracted position. A user views the fixed placard and becomes interested in or is enticed to consider the product or exhibit. The user pulls the tab of the flexible carrier to reveal the additional product advertisement or information. When the user has finished viewing the additional information, he or she releases the tab, and the storage means automatically retracts the flexible carrier. The retrieval mechanism preferably has a braking means to control the speed of retraction by the storage means. The fixed carrier and placard extend only a short distance above and below the shelf, and the larger flexible carrier is normally hidden from view. Thus, the invention provides an advertising and information display which may be attached to a store shelf but which does not significantly obscure any product on that or adjacent shelves. In addition, the display does not interfere with removal of products from the shelf. The invention may also be mounted on walls or any other location where the benefits described can be utilized. The invention is not limited in use to shelving or the like.

BRIEF DESCRIPTION OF THE DRAWINGS

These and other features of this invention will be best understood by reference to the following detailed description of a preferred embodiment of the invention, taken in conjunction with the accompanying drawings, in which:

FIG. 1 is a perspective view of a display device according to the present invention shown in its normal retracted state and mounted on a conventional retail store shelf;

FIG. 2 is a perspective view of the embodiment of FIG. 1 shown in its partially extended position;

FIG. 5 is a side elevation view of the embodiment of FIG. 1, shown with the retail store shelf in dotted lines;

FIG. 6 is an enlarged partial side elevational view showing the portion of FIG. 5 within the view indicator circle labelled "FIG. 6";

FIG. 7 is a rear perspective view of the embodiment of FIG. 1 shown dismounted from the shelf; and FIG. 8 is an enlarged perspective view of a portion of the embodiment of FIG. 1 showing a suitable alternative brake means.

DETAILED DESCRIPTION OF THE PREFERRED EMBODIMENT

Figure 3:
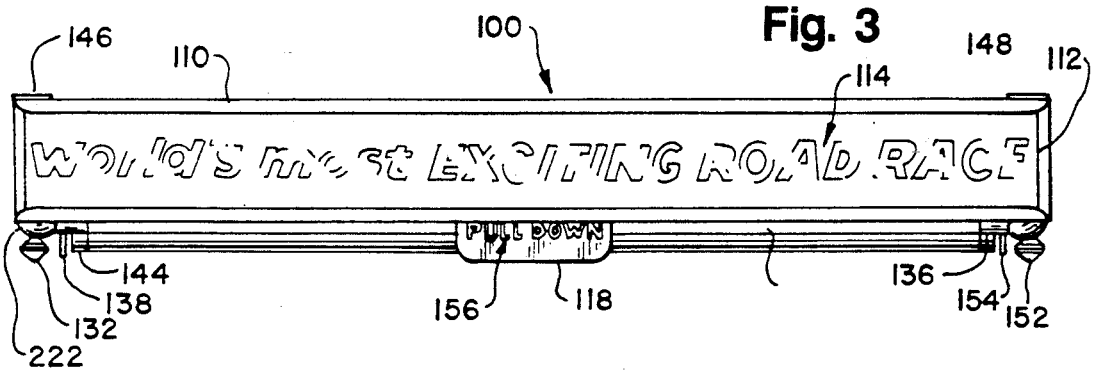
FIG. 3 is a front elevation view of the embodiment of FIG. 1 shown in its normal retracted position.

FIGS. 1–4 show front views of a preferred embodiment 100 of a fixture according to the present invention, which may be used to display advertising or other information to consumers or others. The display fixture 100 comprises a mounting bracket 130 for removably attaching the display 100 to a conventional retail shelving unit 120 or other store fixture, a fixed carrier or support 110 for holding a relatively small, continue displayed, information medium 112, and a user-operable, automatically-retracting roller curtain or carrier 116 for holding a substantially larger, intermittently displayed information medium. The fixed carrier 110 is an essentially rectangular frame or billboard holder 113 for holding the continuously displayed advertising medium or billboard 112, which is preferably a removable user-enticing placard containing an attention getting legend 114 or the like. The fixed carrier 110 and fixed information medium 112 may be of any convenient width less than or equal to that of the receiving shelving unit 120. However, the vertical dimensions of the fixed carrier 110 and medium 112 are preferably limited to an appropriate size so that these components do not extend significantly above or below the shelf 120 to which the display 100 is mounted, thereby avoiding interfering visually or physically with products 140 located on that or adjacent shelves, as shown. While the display 100 is shown in the drawings mounted on a shelving unit, the inventive display could also be mounted on any appropriate structural or wall support in a place visited by the public.

The flexible carrier 116 is preferably constructed from a suitable plastic, cloth, or paper sheet, which is mounted behind the fixed carrier 110 on an appropriate automatically retracting storage means 144 such as a spring-loaded roller. The flexible carrier 116 carries an advertising or informational message 142. The flexible carrier 116 is normally stowed in its hidden, retracted position (FIGS. 1 and 3), but may be pulled by a user 150 into an extended position (FIGS. 2 and 4) to display the message 142. A prominent tab or handle 118 attached to the flexible carrier 116 at support 136 extends outward and downward from the fixed carrier 110 to permit a consumer or user 150 to pull the flexible carrier 116 into its display position. The pull tab 118 defines a small area for display of a message 156 inviting a person 150 to "PULL DOWN FOR ADDITIONAL INFORMATION".

When the flexible carrier 116 is pulled into its extended position (FIGS. 2 and 4), it defines a large visible area, including pull tab 118, for display of the advertising message 142.

Figure 4:
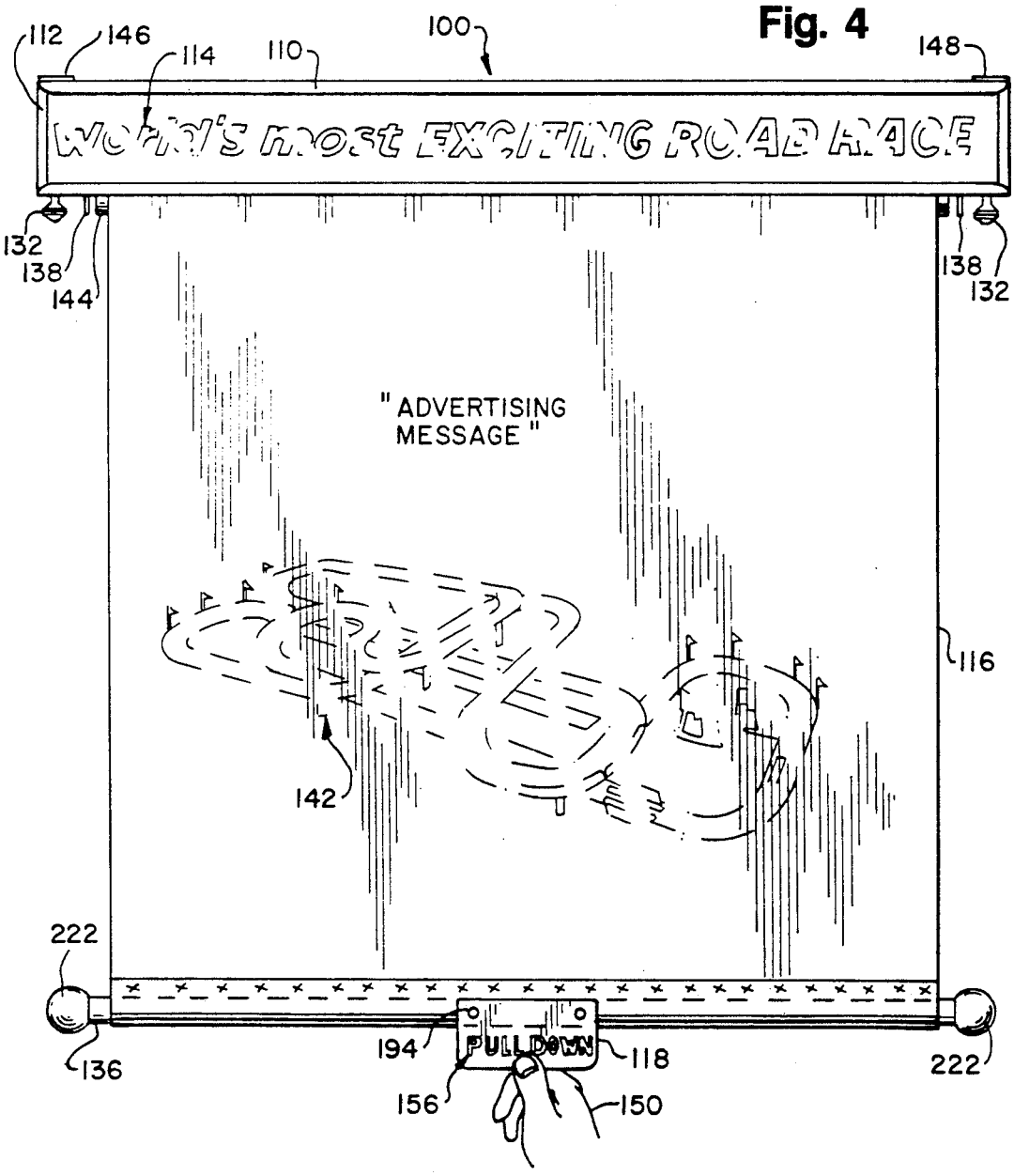
FIG. 4 is a front elevation view of the embodiment of FIG. 1 shown in its fully extended position.

The carrier 116 may be several feet long in its extended position. The informational message 142 is preferably imprinted directly on the carrier 116 as shown in FIGS. 2 and 4, but a separately-prepared medium, such as a large self-adhesive sticker or poster could also be affixed to the carrier 116. This permits use of certain advertising and informational materials not specifically designed for the inventive display. When the user has finished viewing the message 142 on the flexible carrier 116, he may release pull tab 118, permitting the storage means 144 to retract the carrier automatically into the hidden position. Thus, when a user is not actively viewing the message 142, the inventive display 100 does not interfere with viewing or removal of products stored on shelf 120 or adjacent shelves.

The display device preferably includes suitable resistance means, such as a dash pot or friction brake (FIGS. 7–8), connected to the storage means to control the speed at which the flexible carrier 116 is retracted. One type of appropriate resistance means is a leaf spring 202 shown in FIG. 7. The spring 202 may be constructed of any suitable resilient material, such as spring steel or resilient plastic. The spring 202 is attached to the rear flat surface 170 of fixed carrier 110. The spring 202 rubs against the flexible carrier 116 as it is retracted by storage means 144, thereby frictionally resisting retraction and limiting the speed thereof.

An alternative resistance means is depicted in FIG. 8. A modified hanger 204 for supporting retracting storage means 144 includes a bent tab portion 206 which extends under the outermost section of retracting storage means 144. The tab portion 206 has a threaded aperture 214 for supporting a correspondingly threaded bolt 216. A nub 210 constructed of an appropriate friction material, such as rubber, is attached to the upper end of the bolt 216 adjacent the outermost section of retracting storage means 144. The position of nub 210 with respect to storage means 144 is preferably adjusted by rotating bolt 216 so that the nub 210 is in slight frictional engagement with storage means 144. This frictional engagement limits the retraction of the flexible carrier 116 to an appropriate speed. An end cap 212 constructed of or coated with a suitable wear resistant material is preferably installed on the outermost section of retracting storage means 144 to minimize damage thereto from contact with friction nub 210.

A stiff support bar 136 is attached to the bottom end of flexible carrier 116 to ensure that the carrier presents a substantially planar display in its extended position. The support bar 136 also cooperates with elements of mounting bracket 130 to form a stop means, thereby preventing the retracting storage means 144 from pulling the flexible carrier 116 so far behind the fixed carrier 110 that pull tab 118 is no longer visible. Appropriate fasteners 194, such as bolts or rivets, attach pull tab 118 to support bar 136.

End knobs 222 are preferably removably attached to the ends of support bar 136. Knobs 222 promote an attractive appearance and protect users from injury from contact with the outer edges of bar 136. Knobs 222 may be constructed of any appropriate material, such as plastic, rubber, or wood.

The shelf mounting bracket 130 comprises left and right substantially C-shaped bracket pieces 146 and 148 respectively, and a rear structural member 134 joining pieces 146 and 148. Bracket pieces 146, 148 are attached to the extreme ends of fixed carrier 110 using any appropriate means. Left and right clamping bolts 132, 152 provide adjustable pressure to securely but removably attach the bracket pieces 146 and 148 to shelf 120. The mounting brackets could easily take other embodiments, such as springs or more permanent connectors. The retracting storage means 144 is attached to the mounting bracket 130 by left and right attachment hangers 138 and 154 respectively. Rear structural member 134 provides additional stiffness to minimize stress on the fixed carrier 110.

FIGS. 5-7 show the construction and mounting arrangements of the display 100 in greater detail. The embodiment disclosed herein is particularly suitable for mounting the display to a horizontal shelf unit, but such a shelf unit is described only as an example, and equivalent arrangements could be used for attaching the display to other store fixtures, walls, or supporting columns as appropriate. A typical shelf unit 120 has a substantially planar horizontal bearing surface 124. The shelf 120 may have a front vertical face 122 and an inward-projecting bottom lip 164 to provide additional structural rigidity. The shelf 120 may also have a slight upward dimple 162 at the interface between the horizontal surface 124 and the front vertical face 122 of the shelf.

FIGS. 5-7 are side and rear views of the inventive display showing the shelf mounting bracket 130 in greater detail. As shown in FIGS. 5-7, left and right bracket pieces 146, 148 have a modified "C" shape for compatibility with the aforementioned structural features of typical shelving units. Bracket pieces are preferably constructed of a sturdy structural material such as steel, aluminum, or plastic. Left and right bracket pieces 146, 148 are identical; only the left bracket piece 146 will be further described in detail. The innermost segment 196 of the top leg of left bracket piece 146 is flat to provide a surface for secure frictional contact with the horizontal surface 124 of shelf 120. The front portion 166 of the top leg extends upward to provide clearance for the dimple 162 at the front of shelf surface 124.

The side leg 198 extends angularly downward and frontward. Since side leg 198 supports fixed carrier 120, an appropriately selected angle 128 between the side leg 198 and vertical shelf face 122 provides better visibility for the fixed information medium 112. The optimal value for angle 128 depends in part on the height of the shelf to which it is attached, and may vary from 0 degrees for eye-level shelves to about 45 degrees for lower shelves. The bottom leg 158 extends rearward in parallel to the horizontal surface 124 of the shelf. The pull tab can also be positioned to be drawn out of the top of the display, if an advantage in convenience or visibility is thereby achieved.

Structural member 134 attaches left and right bracket pieces 146, 148 to provide additional structural rigidity and to minimize stress on fixed carrier 110. The structural member is preferably constructed from an appropriate stiff material such as steel, aluminum, or plastic, and may have any appropriate cross section, including a hollow cross section. Structural member 134 is attached to the rear-most portion of the bottom leg 158 using any appropriate means. These parts may preferably be welded if structural member 134 and bracket piece 146 are made of compatible metals or plastics.

Storage means 144 for flexible carrier 116 is preferably suspended from hangers 138, 154. Hangers 138, 154 are attached using any appropriate means to the midsection of the bottom legs of bracket pieces 146, 148 and extend downward to provide supports for storage means 144. Storage means 144 is shown here as a spring-loaded cylindrical roller, but other appropriate automatically-retracting storage means might also be used. Shaft 184 extends through mounting holes in hangers 138, 154 to suspend storage means 144. Shaft 184 may also serve as an axle for rotation of storage means 144. The flexible carrier 116 is preferably constructed from a plastic or cloth sheet. Carrier 116 is preferably removably attached to the storage means 144 so that it may be easily replaced if it becomes damaged or if it becomes desirable to display a different message. End knobs 222 are omitted from FIG. 5 to show the detailed construction of support bar 136, flexible carrier 116, and pull tab 118.

Left and right clamping bolts 132, 152 extend upward from the bottom legs of bracket pieces 146, 148 to apply adjustable upward pressure to the bottom surface 102 of the shelf 120, thereby removably clamping the display 100 to the shelf. Clamping bolt 132 is preferably constructed of a sturdy structural material, such as steel, aluminum, or plastic. Clamping bolt 132 has a handle portion 174, a threaded bolt 176, and a bearing surface 180. Clamping bolt 132 is attached to the bottom leg 158 of left bracket piece 146 through a correspondingly threaded thrust plate 178 between hanger 138 and structural member 134. Thrust plate 178 may be constructed of a harder material than bracket piece 146 to provide longer thread life. Bearing surface 180 is preferably constructed as a resilient boot or coating covering the top of threaded bolt 176 to prevent marring of the bottom surface 102 of shelf 120 when the bolt is tightened against the shelf.

As shown in FIG. 4, clamping bolt 132 is preferably located to contact the bottom surface 102 at a position opposing the inner flat segment 196 of the top leg of bracket piece 146. Threaded bolt 176 engages threaded thrust plate 178 to permit adjustment of the vertical position of clamping bolt 132 by turning handle 174. When the display 100 is installed on shelf 120, bolt 132 may be adjusted upward to press firmly against the shelf bottom surface 102, securely clamping the shelf between bearing surface 180 and inner flat segment 196. Pressure of the inner flat segment 196 against the shelf upper surface 124 prevents the display 100 from rocking or otherwise shifting position once secured. Right clamping bolt 152, comprising handle 186, threaded bolt 190, and bearing surface 192 is preferably analogously constructed and engages threaded thrust plate 188 of right bracket piece 148.

Construction of the fixed carrier 110 is shown in greater detail in FIG. 6. Fixed carrier 110 comprises a plate section 170 having top and bottom lips 168, 172 (FIG. 5) for retaining a removable user-enticing advertising placard 112 or other medium. Fixed carrier 110 may be constructed from an appropriate plate or sheet material which will provide sufficient strength and durability for use in a retail or other public environment. The particular configuration of retaining lips 168, 172 is not critical, but the lips should provide a void 104 sufficient to accommodate typical advertising placards constructed of cardboard, plastic, and the like. In addition to retaining placard 112, retaining lip 172 also serves to limit the direction from which the flexible carrier 116 initially exits the storage means 144. As best seen in FIGS. 2 and 4, when the flexible carrier 116 is extended along an initial direction permitted by retaining lip 172, it does not obscure the advertising placard 112. Plate section 170 is attached to left and right bracket pieces 146, 148 using any appropriate means.

Thus, an information and advertising display has been disclosed which may be mounted on a retail-store fixture or other structural support in a place visited by the public such that a large message may be displayed without significantly obscuring visibility or interfering with removal of products located on or near the shelf. The display comprises a removable mounting bracket, a relatively small, continuously displayed attention-getting information medium, and a larger, intermittently displayed information medium. A user attracted by the smaller medium pulls the larger medium from a storage position into a viewing position. The larger medium automatically retracts when the user has finished.

The above-described embodiment of the invention is merely one example of a way in which the invention may be carried out. Other ways may also be possible, and are within the scope of the following claims defining the invention.

What is claimed is:

1. A point of purchase advertising display unit for attachment to store shelving, said display unit comprising a self-retracting roller curtain mounted on a support, said support further having a billboard holder on a front surface thereof continuously displaying a message at the front edge of said shelving, said support and holder having a shape and size approximately conforming to a shape and a size of a front edge of a shelf whereby said curtain, support, and billboard holder do not appreciably interfere with stocking said shelving, means for displaying additional information on said curtain when said curtain is extended from said support, means associated with said curtain for extending and retracting said curtain in response to a purchaser's initiative, said curtain emerging from below and behind said billboard holder when extended and means for removably attaching the unit to said shelving.

2. The display unit of claim 1 wherein said means responsive to a purchaser's initiative is a pull tab containing information for inducing a purchaser to extend said curtain in order to view said additional information.

3. The display unit of claim 2 and means for spreading and maintaining said curtain in a substantially planar condition while it is in said extended position in order to display said additional information.

4. The display unit of claim 3 wherein said means for spreading and maintaining said curtain comprises a rod attached to an outer end of said curtain, and means comprising elastomer members on opposite ends of said rod for protecting persons who may encounter said ends of said rod.

5. The display unit of claim 1 wherein said curtain is mounted on spring-loaded roller means for providing self-retraction.

6. The display unit of claim 5 further comprising means for limiting the rate of self-retraction of said curtain.

7. The display unit of claim 1 wherein said means for removably attaching the unit to said shelving comprises at least one bracket attached to said support and adapted to fit over the shelving and at least one clamping means for securing said bracket to said shelving.

8. The display unit of claim 1 wherein said means for displaying additional information on said curtain has a substantially larger surface for displaying information than said billboard holder.

9. The display unit of claim 1 wherein said billboard holder further comprises means for removing and changing the message displayed on said billboard holder.

* * * * *